US009512521B2

(12) United States Patent
Watanabe et al.

(10) Patent No.: US 9,512,521 B2
(45) Date of Patent: Dec. 6, 2016

(54) MANUFACTURING METHOD OF AND MANUFACTURING APPARATUS FOR METAL OXIDE FILM

(75) Inventors: Akira Watanabe, Miyagi (JP); Eiichi Ohta, Kanagawa (JP); Akira Shimofuku, Kanagawa (JP)

(73) Assignees: RICOH COMPANY, LTD., Tokyo (JP); TOHOKU UNIVERSITY, Miyagi (JP)

( * ) Notice: Subject to any disclaimer, the term of this patent is extended or adjusted under 35 U.S.C. 154(b) by 550 days.

(21) Appl. No.: 13/454,206

(22) Filed: Apr. 24, 2012

(65) Prior Publication Data

US 2012/0276303 A1 Nov. 1, 2012

(30) Foreign Application Priority Data

Apr. 28, 2011 (JP) ..... 2011-101527

(51) Int. Cl.

| | |
|---|---|
| ***C23C 18/06*** | (2006.01) |
| ***C23C 18/12*** | (2006.01) |
| ***C23C 18/14*** | (2006.01) |

(52) U.S. Cl.

CPC ..... *C23C 18/06* (2013.01); *C23C 18/1216* (2013.01); *C23C 18/1245* (2013.01); *C23C 18/1254* (2013.01); *C23C 18/14* (2013.01)

(58) Field of Classification Search

None

See application file for complete search history.

(56) References Cited

U.S. PATENT DOCUMENTS

| | | | | |
|---|---|---|---|---|
| 4,511,595 | A * | 4/1985 | Inoue | 427/581 |
| 5,605,723 | A * | 2/1997 | Ogi et al. | 427/533 |
| 6,787,371 | B2 | 9/2004 | Sawasaki | |
| 2005/0130415 | A1* | 6/2005 | Dordi et al. | 438/674 |
| 2007/0298190 | A1* | 12/2007 | Kobori et al. | 427/595 |
| 2009/0130334 | A1 | 5/2009 | Choy | |
| 2011/0175967 | A1 | 7/2011 | Machida et al. | |
| 2011/0205307 | A1 | 8/2011 | Ueda et al. | |
| 2012/0038712 | A1 | 2/2012 | Akiyama et al. | |

FOREIGN PATENT DOCUMENTS

| | | |
|---|---|---|
| JP | 5-85704 | 4/1993 |
| JP | 9-34113 | 2/1997 |
| JP | 9-315896 | 12/1997 |
| JP | 2000-62076 | 2/2000 |
| JP | 2002-88487 | 3/2002 |

(Continued)

OTHER PUBLICATIONS

Machine translation of JP2005272157 A.*

(Continued)

*Primary Examiner* — Dah-Wei D Yuan
*Assistant Examiner* — Jose Hernandez-diaz
(74) *Attorney, Agent, or Firm* — Cooper & Dunham LLP

(57) ABSTRACT

A method of manufacturing a metal oxide film is disclosed. The method includes the steps of soaking a substrate on which the metal oxide film is formed in a precursor solution for forming the metal oxide film; and irradiating and scanning a light, the light being collected at an interface between the substrate and the precursor solution, wherein the light is transmitted through the precursor solution, and the metal oxide film is formed on the substrate.

6 Claims, 12 Drawing Sheets

(56) References Cited

FOREIGN PATENT DOCUMENTS

| | | | | |
|---|---|---|---|---|
| JP | 2003-298020 | | | 10/2003 |
| JP | 2004-83952 | | | 3/2004 |
| JP | 2005-272157 | | | 10/2005 |
| JP | 2005272157 | A | * | 10/2005 |
| JP | 4108502 | | | 4/2008 |
| JP | 2008138269 | A | * | 6/2008 |
| JP | 2008-266770 | | | 11/2008 |
| JP | 2009-81446 | | | 4/2009 |
| JP | 2009-221037 | | | 10/2009 |
| JP | 2009-224737 | | | 10/2009 |
| JP | 2009-238842 | | | 10/2009 |
| JP | 2010-97728 | | | 4/2010 |
| JP | 2011-111355 | | | 6/2011 |
| JP | 2011-114087 | | | 6/2011 |
| JP | 2012-31022 | | | 2/2012 |

OTHER PUBLICATIONS

Machine Translation of JP2008138269A.*

Tani, Toshihiko, (1994), "Solution-Derived Ferroelectric Thin Films," R&D Review of Toyota Research & Development Insitute, vol. 29, No. 4, pp. 1-11 (with English Translation).

Kamehara, Nobuo et al. (2005), "Ferroelectric Thin Films for Memory Application," Surface Science Society of Japan, vol. 26, No. 4, pp. 194-199 (with English Translation).

Japanese official action dated Nov. 11, 2014 in corresponding Japanese patent application No. 2011-101527.

Jan. 27, 2015 Japanese official action in corresponding Japanese Patent Application No. 2011-101527.

* cited by examiner

MANUFACTURING METHOD OF AND MANUFACTURING APPARATUS FOR METAL OXIDE FILM

TECHNICAL FIELD

The present invention relates to a method of manufacturing a metal oxide film and an apparatus for manufacturing the metal oxide film.

BACKGROUND ART

In a metal oxide, $Pb(Zr,Ti)O_3$ (PZT: lead zirconate-titanate), which has a Perovskite type structure, is a ferrodielectric material and is often used in fields of an actuator, a pressure sensor, etc., using piezoelectric characteristics as a ferrodielectric. Moreover, a PZT thin film, which may be used for various usages such as a non-volatile memory, a piezoelectric device, an optical device, etc., is highly versatile.

As known ferrodielectric materials, there is the above-described PZT, which is a Pb-containing Perovskite type ferrodielectric, and a composite metal oxide such as $SrBi_2Ta_2O_9$(SBT), etc., which is a Bi-containing layer-structured ferrodielectric. In general, a film made of such a ferrodielectric material is usually formed by MOCVD (metal organic chemical vapor deposition) or sputtering (see Non-patent document 1, for example).

However, a large-sized apparatus including an exhaust system is needed in MOCVD and sputtering. Moreover, when it is sought to form a ferrodielectric film into a desired shape, it is necessary to form the ferrodielectric film, then form a resist pattern on the ferrodielectric film, and then have the resist pattern undergo dry etching by RIE (reactive ion etching), etc. Therefore, there is a tendency for the number of steps to become large and the manufacturing cost to become high.

Therefore, in recent years, a simple and easy low-cost method of manufacturing a metal oxide film using a liquid phase process such as a sol-gel method, from which a decreased manufacturing cost is expected is being investigated. In the sol-gel method, first, an organic metal compound to be a raw material of the metal oxide film is dissolved in a solvent made of an organic material, etc., and a network structure of a metal element and oxygen is formed by hydrolysis and condensation reaction to produce a precursor solution. In the method, the metal oxide film is then formed by applying, etc., a precursor solution in sol state on a substrate by spin coating or dip coating (see Patent document 1, Non-patent document 2).

Now, when the metal oxide film is formed on the substrate by the sol-gel method, in a process such that the precursor solution applied, etc., stiffens and becomes the metal oxide film, a detachment of an organic group by the hydrolysis and the condensation reaction and a shrinkage by volatilization of the solvent occur, leading to a likelihood of cracking, etc., occurring in the metal oxide film. Therefore, in order to form the metal oxide film of a desired film thickness, it is necessary, that, with a thickness of a film made of the precursor solution applied, etc., for each round being set to be no greater than 100 nm, a step of applying, etc., the precursor solution and a step of drying and provisional burning be repeated multiple times, and then a step of non-provisional burning be performed at the end. Moreover, for producing a device, etc, which has the metal oxide film, it is usually necessary to form a metal oxide film of at least 1 μm into a desired shape. However, as the metal oxide film has high dry etching resistance, or in other words, an etching rate of the metal oxide film is relatively slow, time is required when forming the metal oxide film into the desired shape, leading to high cost (see Patent document 1, for example).

Moreover, in order to form the ferrodielectric film made of the metal oxide by the sol-gel method, it is necessary to crystallize the metal oxide film, so that a thermal process at a high temperature is conducted. For example, a thermal process at around 700° C. is conducted for forming a PZT film, while a thermal process at around 800° C. is conducted for forming an SBT film. The thermal process for crystallizing such a metal oxide film is usually conducted by heating the whole substrate with a quartz heating furnace, etc., (see Patent Document 1 and Non-patent document 2, for example).

However, the substrate deforms, etc., at a temperature of 500° C. or above for a glass substrate and at a temperature of 200° C. or above for a plastic substrate, so that it is not preferable to heat the whole substrate in order to crystallize the metal oxide film depending on a material which makes up the substrate. Thus, there is a demand for crystallizing the metal oxide film at a temperature of below 500° C. for the glass substrate and at a temperature of below 200° C. for the plastic substrate.

Therefore, as a method of forming the metal oxide film which is crystallized at a low temperature, there is laser anneal, in which laser is irradiated on the metal oxide film formed so as to crystallize the formed metal oxide film; however, even in this case, cracking, etc., are likely to occur as the metal oxide film shrinks due to shrinkage by the laser light irradiation. Moreover, in order to form the metal oxide film into a desired shape, it is necessary to conduct forming of the resist pattern and etching, etc., by RIE, etc., so that it is not possible to reduce the number of steps.

Patent Document

Patent document 1 JP5-85704A

Non-Patent Documents

Non-patent document 1: Nobuo Kamehara, Mineharu Tsukada, Jeffrey S. CROSS, "Memory applications of ferrodielectric thin film", Surface science, 2005, vol. 26, no. 4, pages 194-199

Non-patent document 2: Toshihiko Tani, "Ferrodielectric thin film synthesized from solution", R&D Review of Toyota Research & Development Institute, 1994, Vol. 29, No. 4, Pages 1-11.

DISCLOSURE OF THE INVENTION

In light of the problems as described above, an object of the present invention is to form a metal oxide film which is crystallized at a low temperature into a desired shape, and another object of the present invention is to form the crystallized metal oxide film at low cost.

According to an embodiment of the present invention, a method of manufacturing a metal oxide film is provided, including the steps of soaking a substrate on which the metal oxide film is formed in a precursor solution for forming the metal oxide film; and irradiating and scanning a light, the light being collected at an interface between the substrate and the precursor solution, wherein the light is transmitted through the precursor solution, and the metal oxide film is formed on the substrate.

According to another embodiment of the present invention, an apparatus which manufactures a metal oxide film is provided, the apparatus including a precursor solution placed in a solution holder; a substrate soaked in the precursor solution; a light source which emits a light of a wavelength that transmits through the precursor solution; and a stage which moves a position of the solution holder, wherein the light is to be collected at an interface between the precursor solution and the substrate, and wherein the stage relatively moves a position of the light collected at the interface with the light being collected.

The embodiments of the present invention make it possible to form a metal oxide film crystallized at a low temperature into a desired shape and also to form the crystallized metal oxide film at low cost.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Figure 1:
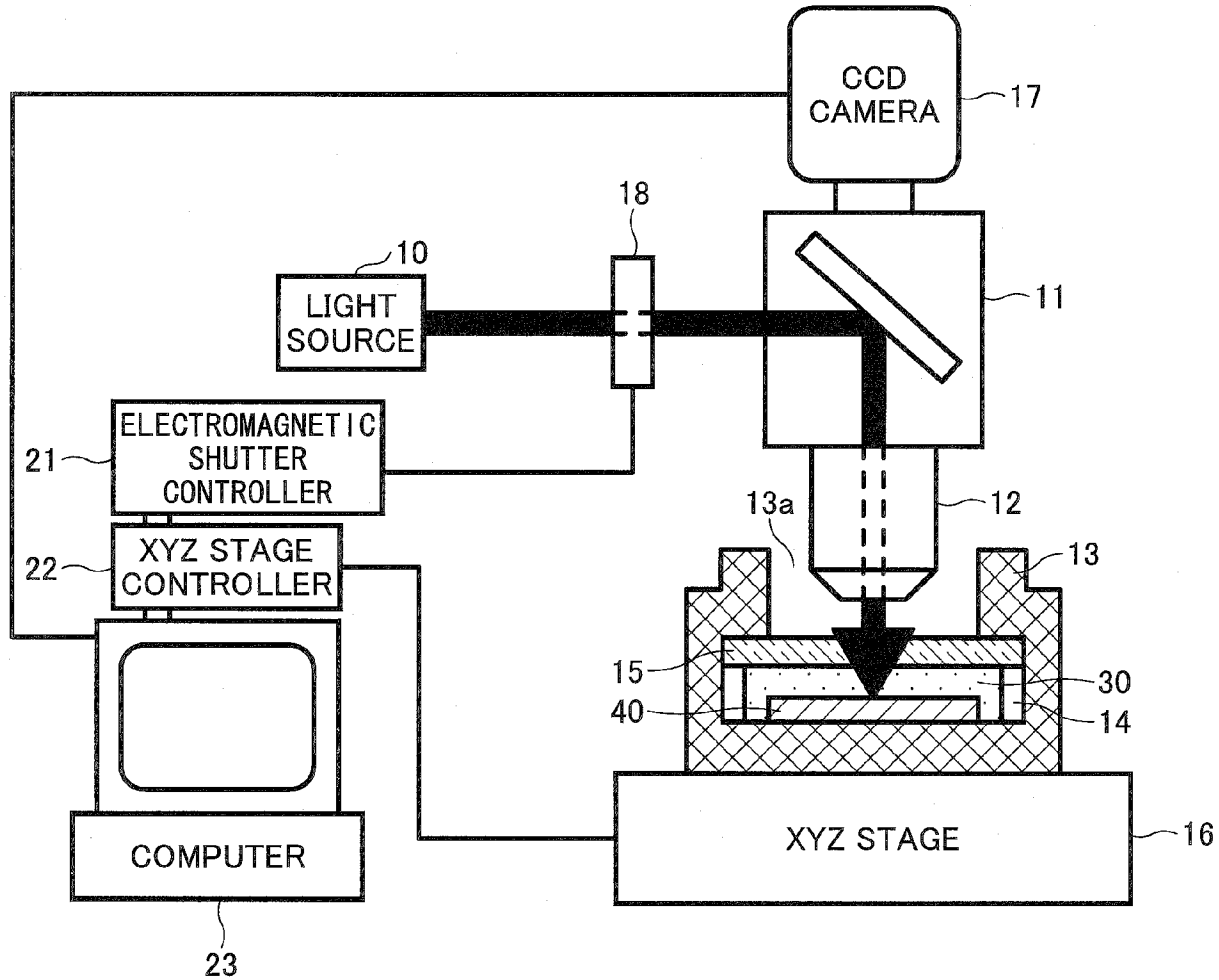
FIG. 1 is a structural diagram of a manufacturing apparatus of a metal oxide film according to a first embodiment.

Embodiments of the present invention are described below. The same characters are assigned to the same members, etc., so that a repeated explanation thereof is omitted.

(First Embodiment)

A method of and an apparatus for manufacturing a metal oxide film according to a first embodiment is described.

(Apparatus for Manufacturing Metal Oxide Film)

First, an apparatus for manufacturing the metal oxide film according to the present embodiment is described. The apparatus for manufacturing the metal oxide film according to the present embodiment includes a light source 10, optics 11, an objective lens 12, a solution holder 13, a spacer 14, a glass substrate 15, an XYZ stage 16, a CCD (Charge coupled device) camera 17, an electromagnetic shutter 18, an electromagnetic shutter controller 21, an XYZ stage controller 22, and a computer 23.

A precursor solution 30 for forming the metal oxide film is placed inside the solution holder 13, while a substrate 40 on which the metal oxide film is formed is installed inside the solution holder 13 such that the whole substrate soaks in the precursor solution 30.

The light source 10, for which a laser light source which emits a laser light is used, is used by appropriately selecting in accordance with a type of the precursor solution 30, the substrate 40, and the metal oxide film formed. More specifically, the light source 10 includes a continuous wave (CW) diode-pumped solid state (DPSS) laser with an oscillating wavelength of 457, 473, 488, 532, 561, 600, or 1064 nm; a pulse oscillating laser with an oscillating wavelength of 266, 355, 532, or 1064 nm; an He—Cd laser with an oscillating wavelength of 325 or 442 nm; an Ar ion laser with an oscillating wavelength of 488 or 514.5 nm; a Titanium-sapphire laser with an oscillating wavelength of 800 nm; a semiconductor laser with an oscillating wavelength of 405, 408, 442, 473, 638, 658, 780, or 830 nm; an excimer laser with an oscillating wavelength of 193, 248, 308, or 353 nm; a fiber laser with a oscillating wavelength from an ultraviolet range to an ultrared range, etc. The laser, etc., used for the light source 10 is not limited thereto. In the present embodiment, continuous wave diode-pumped solid-state lasers are used, including Laser Quantum, Inc., Ventus 532 (532 nm, 500 mw); CNI, Inc. MgL-H-532-1W (532 nm, 1.18 w, $TEM_{00}$ mode) and Kimmon Koha Co., Ltd. (Violet DPSS laser, 405 nm, 100 mw), for example.

For the optics 11, an optical microscope is used and BX51 (manufactured by Olympus) is used in the present embodiment. This is to collect light from the light source 10, etc.

For the objective lens 12, which is connected to the optics 11, SLMPlan20× (N.A. 0.35), SLMPlan50× (N.A. 0.45), and SLMPlan100× (N.A. 0.8) are used in the present embodiment.

The solution holder 13, which is formed with a structure such that the precursor solution 30 may be accumulated therein, is provided with an opening portion 13*a* for the light to be incident thereon.

The spacer 14 is for installing a below-described glass substrate 15 at a predetermined position in the solution holder 13.

The glass substrate 15, which is made of a material which transmits a light of a wavelength of the light source 10, is installed such that it is in contact with an upper face of the precursor solution 30 and that the opening 13*a* of the solution holder 13 is blocked.

The XYZ stage 16 may move the solution holder in x-axis y-axis, and z-axis directions, thereby making it possible to irradiate a light from the light source 10 onto a predetermined position of the substrate 40 which is installed inside the solution holder 13. In the present embodiment, TSDM60-20, SPSD60-10ZF (Sigma Koki Co., Ltd.) are used. A scanning scheme is not limited to a sweeping scheme by the XYZ stage 16, so that scanning using a more high-speed and industrial system such as a Galvano mirror system can also be used, for example.

For the CCD camera 17, which is for observing the metal oxide film formed on a surface of the substrate 40, WAT231S2 (Watec Co., Ltd.) is used in the present embodiment.

The electromagnetic shutter 18, which is provided between the light source 10 and the optics 11, performs an operation of opening and closing depending on whether the light from the light source 10 is caused to be incident onto the optics 11. In the present embodiment, SSH-R (manufactured by Sigma Koki) is used.

The electromagnetic shutter controller 21, which is for controlling the opening and the closing of the electromagnetic shutter 18, is connected to the below-described computer 23. In the present embodiment, SSH-CB4 (Sigma Koki) is used.

The XYZ stage controller 22, which is for controlling a drive operation of the XYZ stage 16, is connected to the below-described computer 23. In the present embodiment, SHOT-204MS (Sigma Koki) is used.

The precursor solution 30, which is an organic metal compound to be a material which forms the metal oxide film being dissolved in a solvent, is a uniform solution in which a network structure of a metal element and oxygen is formed by hydrolysis and condensation reaction.

For the substrate 40, which is a substrate for forming the metal oxide film, a glass substrate or a silicon substrate may be used. In the present embodiment, the silicon substrate is used.

(Method of Manufacturing Metal Oxide Film)

Figure 2:
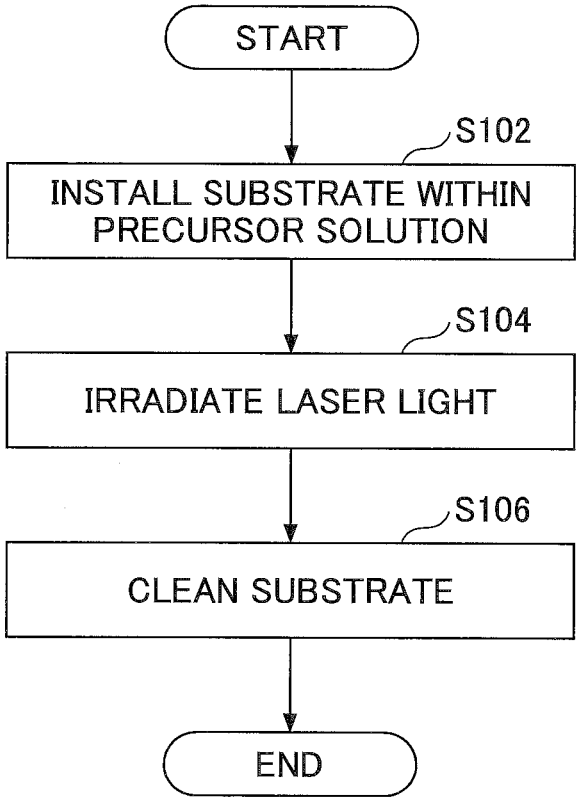
FIG. 2 is a flowchart of a manufacturing method of the metal oxide film according to the first embodiment.

Next, a method of manufacturing the metal oxide film in the present embodiment using the apparatus for manufacturing the metal oxide film in the present embodiment is described based on FIG. 2.

First, in step 102 (S102), the substrate 40 is dipped into the precursor solution 30. More specifically, in the apparatus for manufacturing the metal oxide film according to the present embodiment, the substrate 40 is dipped into a desired position within the solution holder 13 in which the precursor solution 30 is placed and the substrate 40 is installed at the desired position.

Figure 3A:
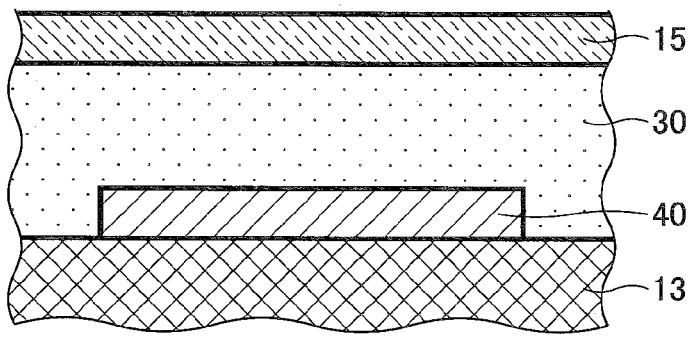
FIGS. 3A, 3B, and 3C are diagrams for explaining the manufacturing method of the metal oxide film according to the first embodiment.
Figure 3B:
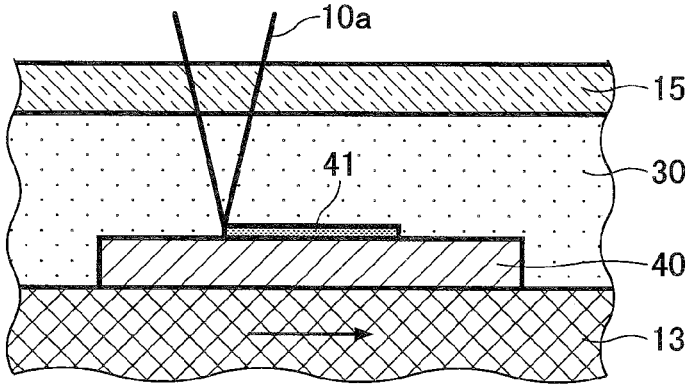

Next, in step 104 (S104), a laser light from the light source 10 is collected onto a face at which the substrate 40 is in contact with the precursor solution 30. More specifically, the laser light from the light source 10 is caused to be incident on the optics 11 and is collected, by the objective lens 12, onto the face at which the substrate 40 is in contact with the precursor solution 30, so that the XYZ stage 16 is driven via the XYZ stage controller 22 by control of the computer 23. More specifically, as shown in FIG. 3B, the substrate 40 is caused to be moved with the laser light 10*a* being collected onto a desired area of the surface of the substrate 40, thereby forming the metal oxide layer 41. In other words, with the method of forming the metal oxide film according to the present embodiment, the precursor solution may be hardened by heating, etc., only at the area onto which the laser light 10*a* of the surface of the substrate 40 is collected to form the metal oxide film 41 and, at the same time, to crystallize the metal oxide film 41 formed. Moreover, an interface of the metal oxide film 41 formed is in contact with the precursor solution 30, so that cracking due to crystallization, etc., does not occur. Furthermore, the metal oxide film 41 may be formed only at the area on the surface of the substrate 40, on which area the laser light is irradiated, making it possible to form a crystallized metal oxide film 41 into a desired shape at low cost without conducting etching by RIE, etc., and forming of the photo resist.

Figure 3C:
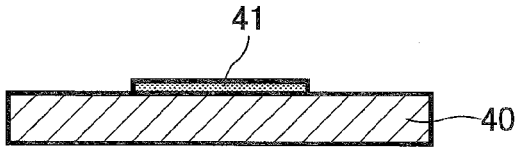

Next, in step 106 (S106), the substrate 40 on which the metal oxide film 41 is formed is taken out of the solution holder 13, and cleaned in order to remove the precursor solution. In this way, as shown in FIG. 3C, a metal oxide film 41 with crystallized PZT, etc., may be formed on the surface of the substrate 40.

While the present embodiment is described for a case of forming a crystallized PZT or SBT as the metal oxide film 41, it may also be applied to cases of producing a different ferrodielectric material or a different metal oxide film.

(Second Embodiment)

Figure 4:
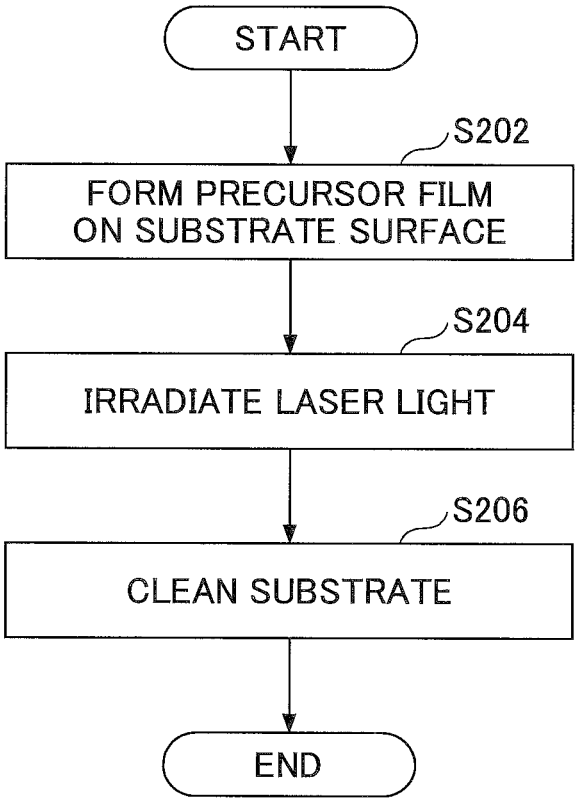
FIG. 4 is a flowchart of the manufacturing method of the metal oxide film according to a second embodiment.

Next, the second embodiment is described. Based on FIG. 4, a method of manufacturing the metal oxide film according to the present embodiment is described.

Figure 5A:
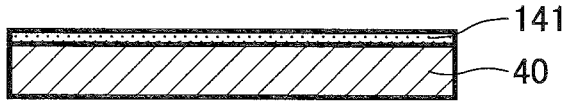
FIGS. 5A, 5B, and 5C are diagrams for explaining the manufacturing method of the metal oxide film according to the second embodiment.

First, in step 202 (S202), a film (a precursor film) 141 which includes a precursor solution is formed on the surface of the substrate 40. More specifically, the precursor solution is applied onto the substrate surface by spin coating, etc., and post-baked, etc., thereby forming the precursor film 141 on the surface of the substrate 40 as shown in FIG. 5A. The precursor solution used in the present embodiment includes a solvent having a melting point at a temperature greater than or equal to normal temperature.

Figure 5B:
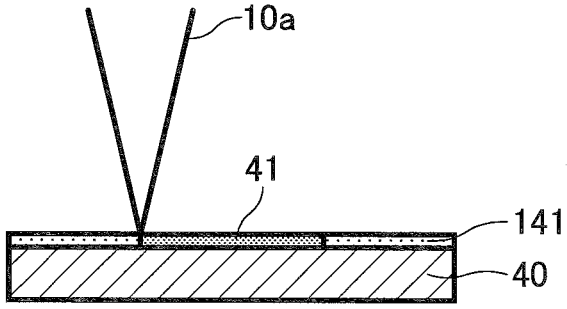
Figure 6:
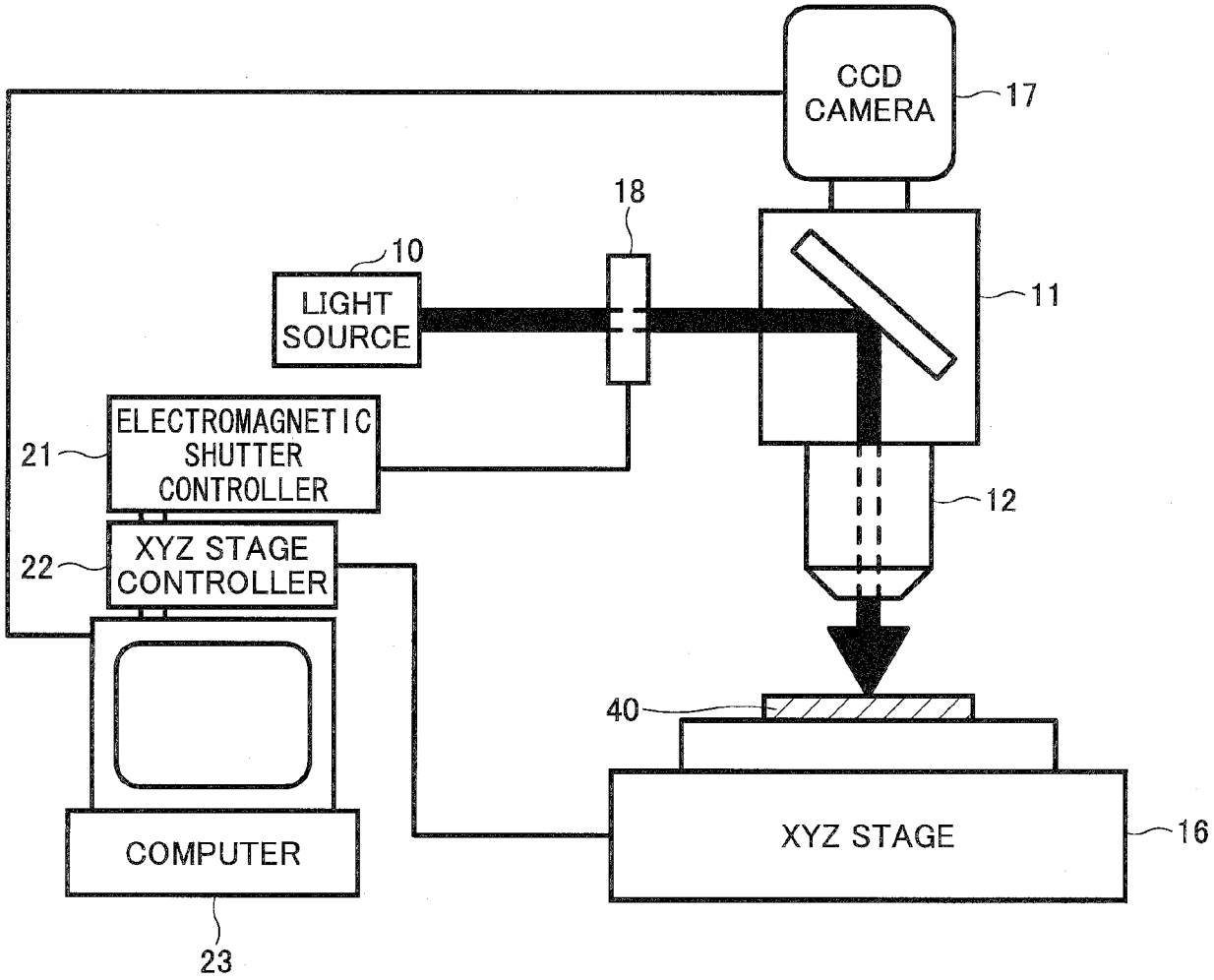
FIG. 6 is a structural diagram of the manufacturing apparatus of the metal oxide film according to the second embodiment.

Next, in step 204 (S204), the substrate 40 on which the precursor film 141 is formed is installed at a predetermined position of the manufacturing apparatus of the metal oxide film in the present embodiment, and a laser light is irradiated thereupon, thereby forming the metal oxide film on a desired area. More specifically, as shown in FIG. 6, the manufacturing apparatus for the metal oxide film that is used in the present embodiment has a structure with neither one of the solution holder 13, the spacer 14, and the glass substrate 15 in the apparatus for manufacturing the metal oxide film in the first embodiment. In other words, the apparatus for manufacturing the metal oxide film according to the present embodiment includes the light source 10, the optics 11, the objective lens 12, the XYZ stage 16, the CCD camera 17, the electromagnetic shutter 18, the electromagnetic shutter controller 21, the XYZ stage controller 22, and the computer 23. Using the apparatus for manufacturing this metal oxide film, the laser light is collected onto the desired area of a face on which the precursor film 141 of the substrate 40 is formed. More specifically, the laser light from the optical source 10 is caused to be incident onto the optics 11, and is collected onto the surface of the substrate 40 on which the precursor film 141 of the substrate 40 is formed. In this state, the XYZ stage 16 is driven via the XYZ stage controller 22 by a control of the computer 23. In this way, as shown in FIG. 5B, the substrate 40 is caused to be moved with the laser light 10*a* being collected to the desired area of the surface of the substrate 40, thereby forming a crystallized metal oxide layer 41 from the precursor film 141.

Figure 5C:
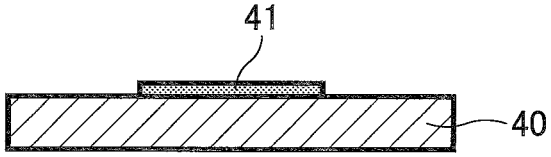

Next, in step 206 (S206), cleaning is conducted for removing the precursor film 141 which is affixed to the substrate 40 on which the metal oxide film 41 is formed. In this way, as shown in FIG. 5C, the metal oxide film 41 with the crystallized PZT, etc., may be formed on the surface of the substrate 40.

Other elements in the above embodiment are the same as the first embodiment.

EXAMPLES

Next, Examples are described. A cofocal laser microscope used in Examples is a three-dimensional (3D) cofocal laser microscope, or a color 3D laser microscope VK-9700 (Keyence Corporation). Moreover, for a microscopic Raman spectroscopic apparatus, a laser light source is a continuous wave (CW) diode-pumped solid-state (DPSS) laser (Ventus 532 (532 nm, 500 mW), Laser Quantum, Inc.); a spectroscope is ORIEL Inc.'s 77385; and a cooling-type CCD camera is Apogee inc.'s AP260EP.

Example 1

Example 1 is described. Example 1 is a precursor solution and a method of manufacturing the precursor solution. More specifically, with lead acetate trihydrate, titanium isopropoxyde, zirconium n-propoxyde as starting materials and methoxyethanol (2-Methoxyethanol (ethylene glycol monomethyl ether) as a common solvent, a PZT precursor solution is adjusted by the sol-gel method. Lead acetate trihydrate is dissolved in methoxyethanol and, after dehydration, a predetermined amount of Ti, Zr starting materials are added, and a sol-gel liquid (Concentration: 0.5 mol/l) is obtained through alcohol exchange reaction and esterification reaction. This sol-gel solution is to be a precursor solution for manufacturing a metal oxide film containing PZT.

Figure 7:
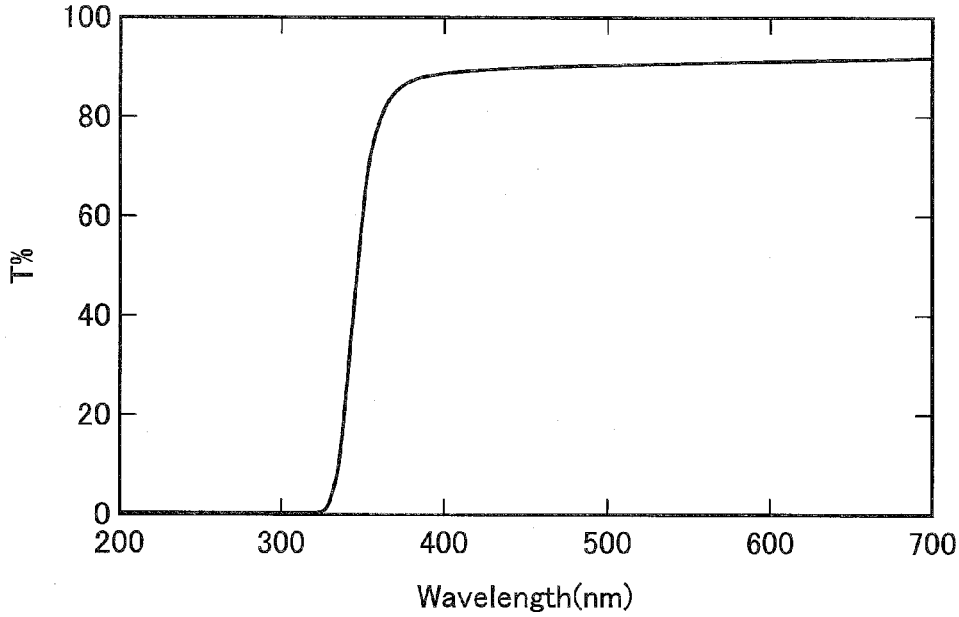
FIG. 7 is a characteristic diagram of a transmittance of a precursor solution.
Figure 8:
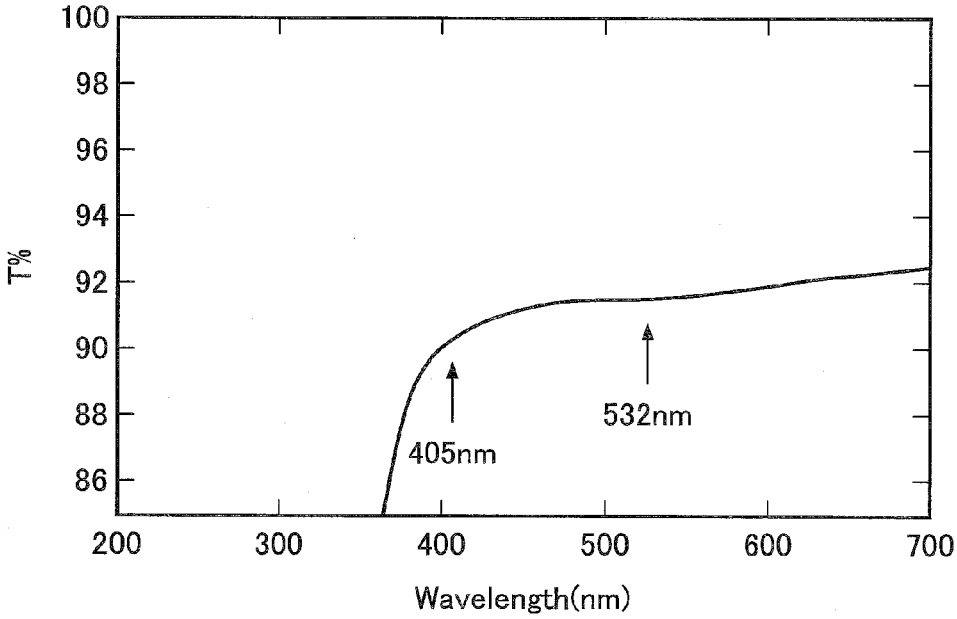
FIG. 8 is an enlarged diagram of a main part of a characteristic of the transmittance of the precursor solution.

A light transmittance of the thus obtained precursor solution is shown in FIGS. 7 and 8. FIG. 8 is a diagram with a portion of FIG. 7 being exploded. In the first and second embodiments, as described below in Examples 2 to 4, a high transmittance of 90% or above is achieved at wavelengths emitted from the light source 10, or wavelengths (532 nm, 405 nm) used for forming the metal oxide film. In this way, as the precursor solution has a high transmittance, light is not absorbed by the precursor solution, making it possible to form a metal oxide film without irregularity in a film thickness direction.

Example 2

Example 2 is a method of manufacturing the metal oxide film using the precursor solution in Example 1 and a method of manufacturing the metal oxide film in the first embodiment. More specifically, the precursor solution in Example 1 is used to form the metal oxide film with the apparatus for manufacturing the metal oxide film shown in FIG. 1. The substrate 40 is an $SiO_2$ layer and a lanthanum oxide nickel ($LaNiO_3$) layer laminated in the exact order on a surface of a silicon substrate. The light source 10, which uses a laser light source with a wavelength of 532 nm, is installed such that a laser light is collected onto a surface of the substrate 40 that is in contact with the precursor solution 30. Irradiating conditions of the light source 10 are that the objective lens 12 of 20× (20 times, N.A. 0.32) is used and an incident laser light power is 100 mW and that irradiating conditions of the laser light are that a scanning line interval is 10 μm and a scanning speed is 100 μm/s. Here, a temperature is 22° C. After the laser light is irradiated, the substrate 40 is cleaned using a methanol solvent to remove the unnecessary precursor solution 30.

Figure 9A:
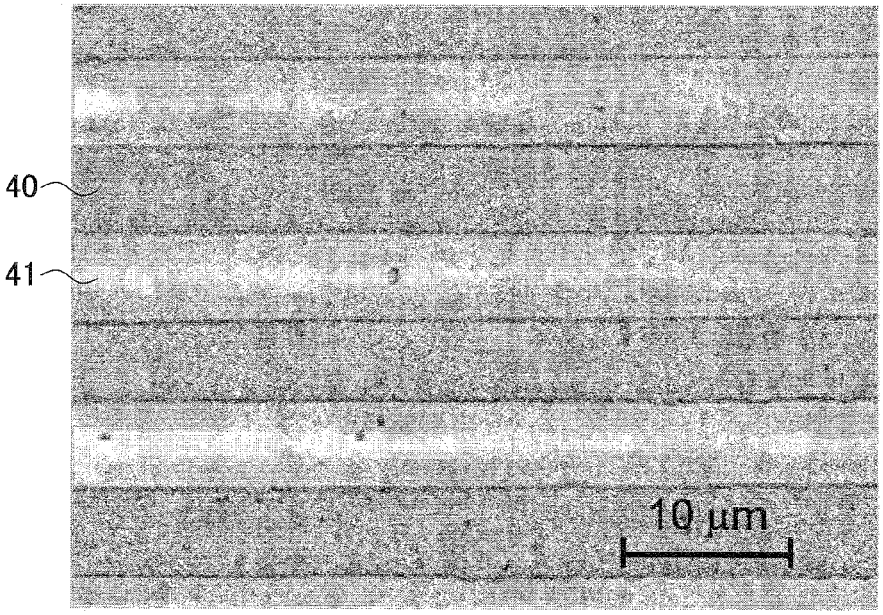
FIGS. 9A and 9B are a photograph and a 3D image of the metal oxide film formed according to Example 2.
Figure 9B:
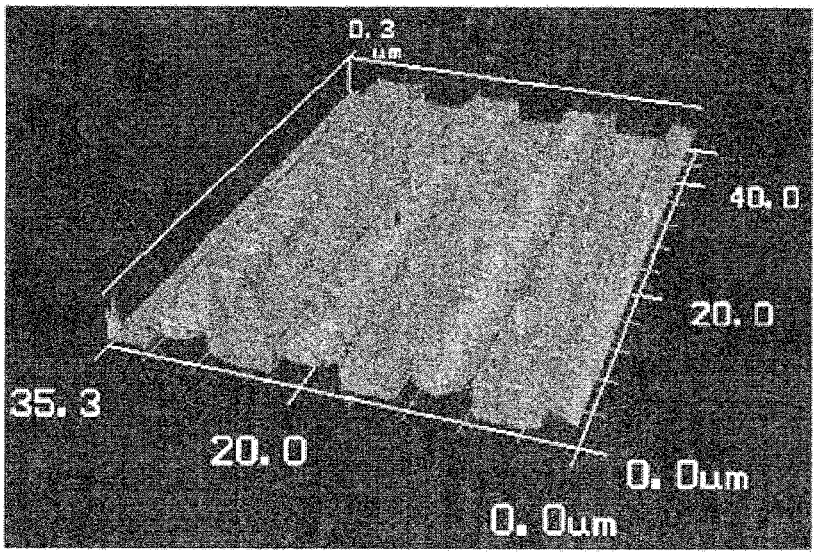

FIGS. 9A and 9B show the metal oxide film 41 formed in the present Example. FIGS. 9A and 9B are a photograph by the cofocal laser microscope and a three-dimensional image on the surface. As shown in FIGS. 9A and 9B, it is possible to form a pattern including the metal oxide film 41 with a thickness of approximately 150 nm and a line width of approximately 5 μm.

Figure 10:
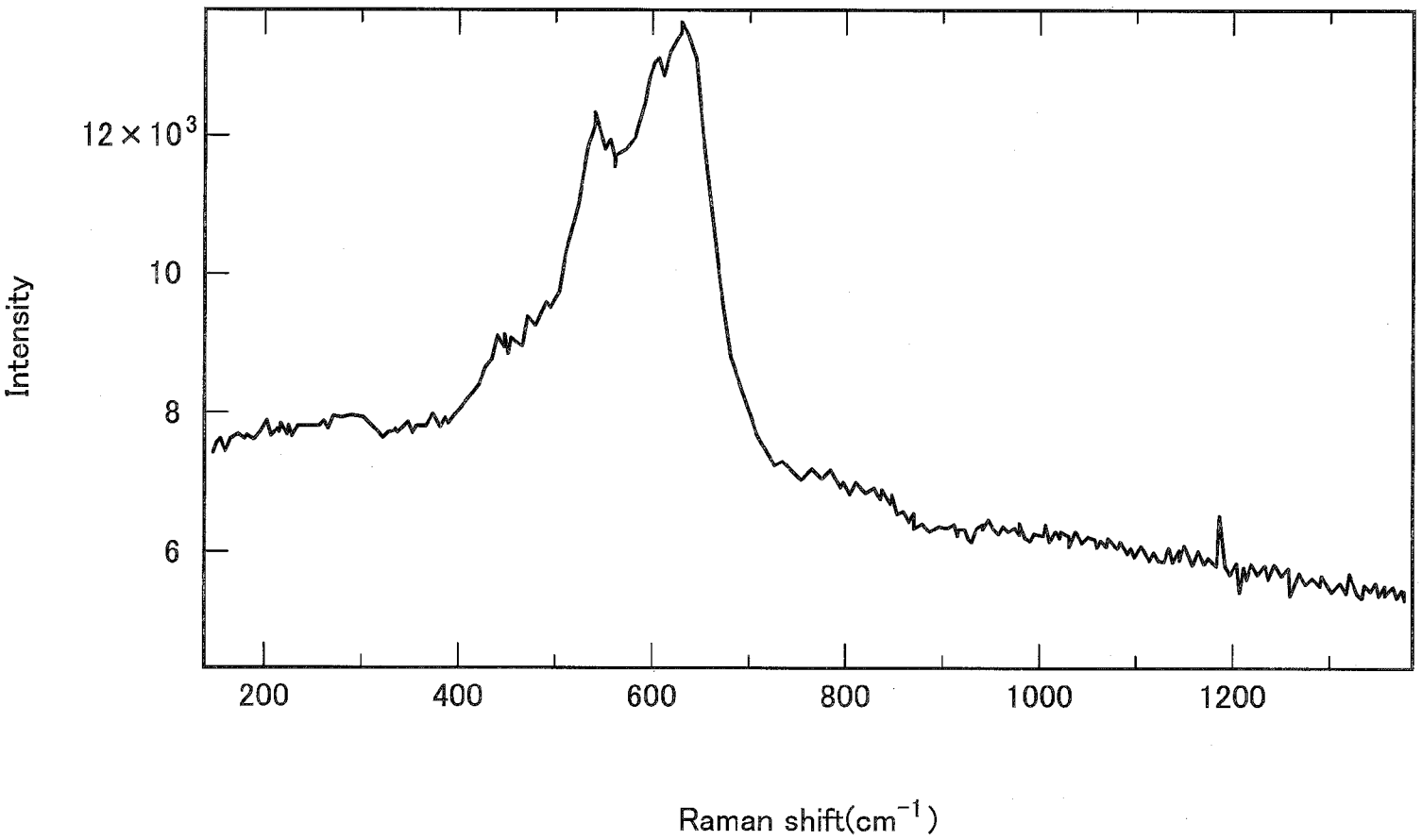
FIG. 10 is a microscopic Raman spectrum of the metal oxide film formed in Example 2.

FIG. 10 shows a microscopic Raman spectrum of the metal oxide film 41 formed in the present Example. A sharp band of 600 $cm^{-1}$ that is seen in the metal oxide film 41 formed in the present Example is characteristic of a selectively c-axis-oriented PZT crystallized film. This is considered to be due to the selective c-axis orientation being induced as the $LaNiO_3$ layer, which is formed on the silicon substrate and which has a pseudocubic Perovskite structure, has a good affinity with a Perovskite-type ferrodielectric thin film.

Example 3

Example 3 is a method of manufacturing the metal oxide film using the precursor solution in Example 1 and a method of manufacturing the metal oxide film in the first embodiment. More specifically, the precursor solution in Example 1 is used to form the metal oxide film with the apparatus for manufacturing the metal oxide film shown in FIG. 1. The substrate 40 on which the metal oxide film 41 is formed is a glass substrate, while a laser light source with a wavelength of 405 nm is used for the light source 10. The glass substrate to be the substrate 40 is installed such that a light which transmits to a back face of the glass substrate, or a light which transmits through the glass substrate is collected onto a face at which the glass substrate is in contact with the precursor solution 30. More specifically, when the substrate 40 is installed inside the solution holder 13, a slight gap is created between the solution holder 13 and the substrate 40, and light is irradiated onto the precursor solution which gets into the gap to form the metal oxide film 41. The substrate 40 may be a substrate which transmits light, such as the glass substrate, so that as long as it is soaked in the precursor solution 30, the metal oxide film 41 may similarly be formed on a back face which is on the opposite side of the side at which light is irradiated. In this way, a glass substrate which transmits light can be used as the substrate 40 to form a metal oxide film on a face which is on the opposite side of the side at which light is irradiated. Irradiating conditions of the light source 10 are that the objective lens 12 of 50× (50 times, N.A. 0.45) is used and the incident laser light power is 100 mW and that irradiating conditions of the laser light are that the scanning line interval is 1 μm and the scanning speed is 500 μm/s. Here, the temperature is 22° C. After the laser light is irradiated, the substrate 40 is cleaned using the methanol solvent to remove the unnecessary precursor solution 30.

Figure 11A:
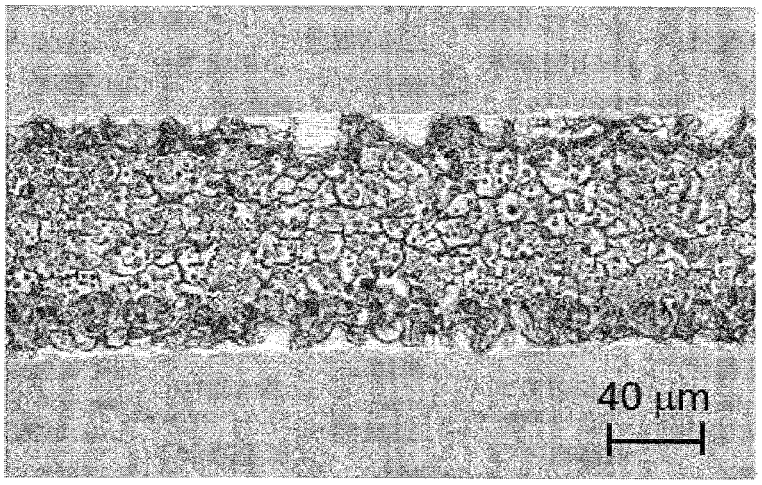
FIGS. 11A and 11B are a photograph and a 3D image of the metal oxide film formed according to Example 3.
Figure 11B:
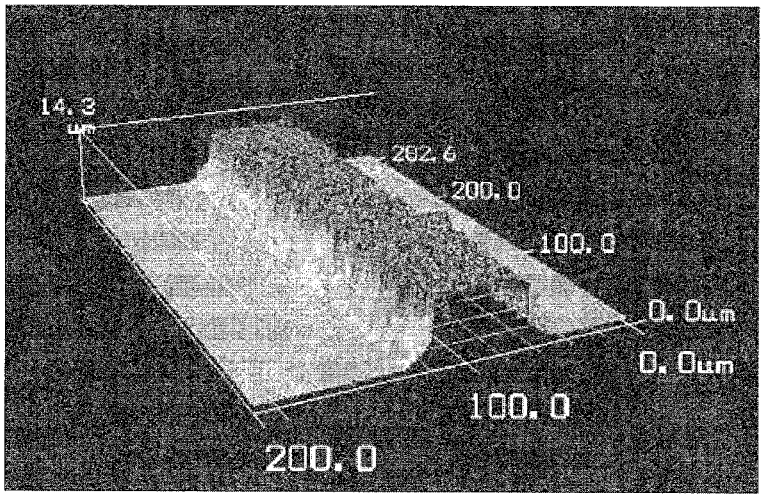

FIGS. 11A and 11B show a metal oxide film formed in the present example. FIGS. 11A and 11B are a photograph by the cofocal laser microscope and a three-dimensional image on the surface. As shown in FIGS. 11A and 11B, it is possible to form a pattern including the metal oxide film 41 with a thickness of approximately 10 μm.

Figure 12:
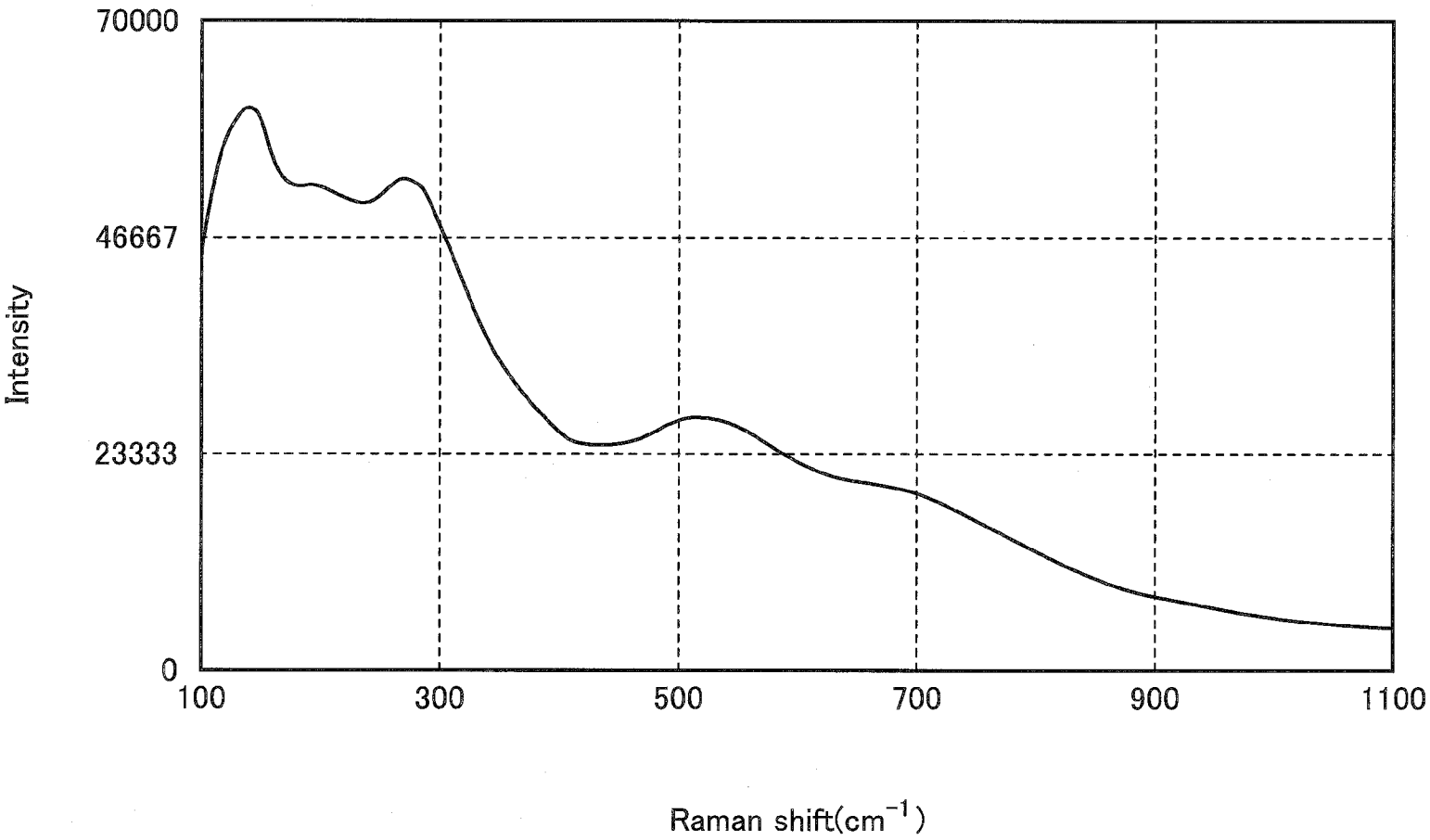
FIG. 12 is a microscopic Raman spectrum of the metal oxide film formed according to Example 3.

FIG. 12 shows a microscopic Raman spectrum of the metal oxide film 41 formed in the present Example. In the metal oxide film formed in the present embodiment, a broad Raman band is observed around 550 $cm^{-1}$, indicating that it is a PZT film having a Perovskite type crystal structure. The difference from the Raman spectrum shown in FIG. 10 for Example 2 is due to whether there is a $LaNiO_3$ layer formed on the substrate.

Example 4

Example 4 is a method of manufacturing the metal oxide film according to the second embodiment. For the precursor solution used in the present Example, the precursor solution is adjusted such that it becomes a solid film before laser light irradiation and a liquefying film with the laser light irradiation by adding 10 wt % polyethylene glycol (PEG1540, Wako Pure Chemical Industries, Ltd.; boiling point of 250° C. or above) with a melting point of between 43° C. and 47° C. to the precursor solution in Example 1.

The precursor solution is applied onto the silicon substrate to be the substrate 10 by spin coating and is post-baked for 20 seconds at 150° C. to form the precursor film 141. The number of rotations in the spin coating is 1000 rpm. Moreover, the boiling point of 2-Methoxyethanol, which is used as the solvent, is 124° C. Thus, with the post-baking, 2-Methoxyethanol vaporizes, and polyethylene glycol solidifies after the post-baking, so that the precursor film 141 becomes solid.

Thereafter, with the apparatus for manufacturing the metal oxide film shown in FIG. 6, a laser light is irradiated from the light source 10. The light source 10 used in the present Example, which is a laser light source with a wavelength of 405 nm, is installed such that the light is collected onto the surface of the glass substrate that is in contact with the precursor solution 30. Irradiating conditions of the light source 10 are that the objective lens 12 of 100× (100 times, N.A. 0.80) is used and the incident laser light power is 100 mW and that irradiating conditions of the laser light are that the scanning line interval is 1 μm and the scanning speed is 500 μm/s. Here, the temperature is 22° C. After the laser light is irradiated, the substrate 40 is cleaned using a methanol solvent to remove the unnecessary precursor solution 30.

Figure 13A:
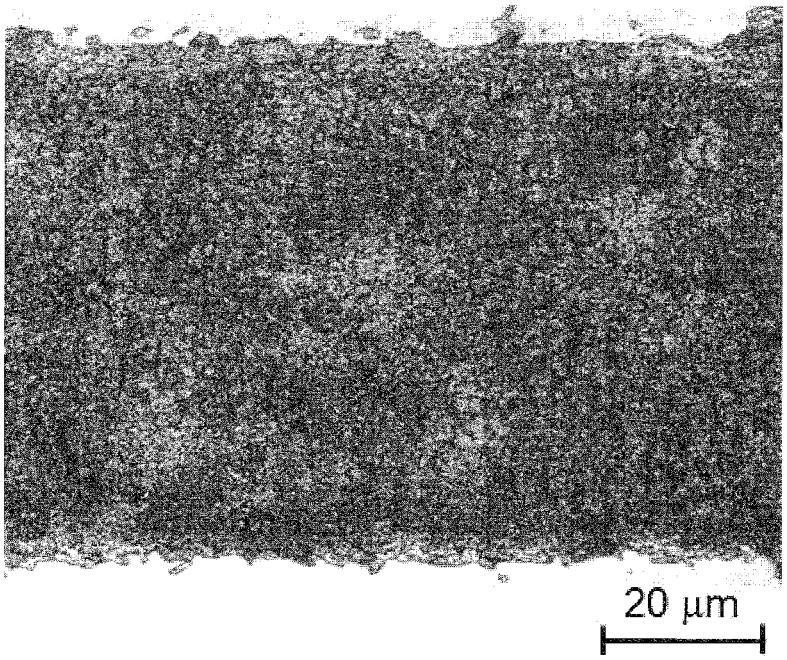
FIGS. 13A and 13B are a photograph and a 3D image of the metal oxide film formed according to Example 4.
Figure 13B:
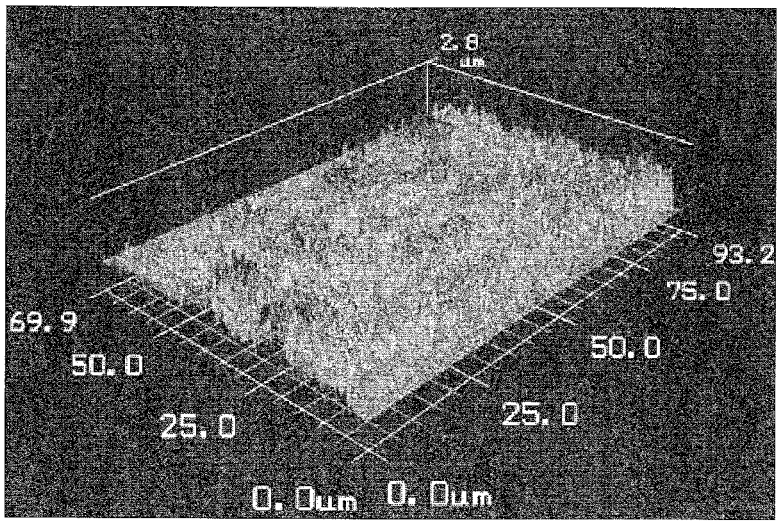

FIGS. 13A and 13B show a metal oxide film formed in the present example. FIGS. 13A and 13B are a photograph by the cofocal laser microscope and a three-dimensional image on the surface. As shown in FIGS. 13A and 13B, it is possible to form a pattern including the metal oxide film 41 with a thickness of approximately 1 μm.

While the embodiments of the present embodiment have been described in the foregoing, the present invention is not limited thereto.

The present application is based on Japanese Priority Application No. 2011-101527 filed on Apr. 28, 2011, the entire contents of which are hereby incorporated by reference.

The invention claimed is:

1. A method of manufacturing a ferrodielectric film made of a metal oxide film by the sol-gel method, comprising the steps of:

soaking a first substrate on which the metal oxide film is to be foinied in a precursor solution for forming the ferrodielectric film made of the metal oxide film, and accumulating the precursor solution in a solution holder;

installing a glass substrate at a predetermined position inside the solution holder such that the glass substrate contacts an upper face of the precursor solution and is disposed above the first substrate and the precursor solution, to block an opening of the solution holder;

collecting a light by lens onto an interface where the first substrate contacts the precursor solution, the light collected by the lens passing through the glass substrate and the precursor solution; and moving the light or the first substrate to scan the light while maintaining a condition of collecting the light passing through the glass substrate and the precursor solution onto the interface, to heat and crystallize the precursor solution at the interface, to form the ferrodielectric film made of the metal oxide film on the first substrate.

2. The method of manufacturing the metal oxide film as claimed in claim 1, further comprising cleaning for removing the precursor solution after irradiating and scanning the light.

3. The method of manufacturing the metal oxide film as claimed in claim 1, wherein the first substrate is a glass substrate or an epoxy substrate.

4. The method of manufacturing the metal oxide film as claimed in claim 1, wherein the light is a laser light.

5. The method of manufacturing the metal oxide film as claimed in claim 1, wherein a transmittance of the precursor solution is greater than or equal to 90% at a wavelength of the light.

6. A method of manufacturing a ferrodielectric film made of a metal oxide film by the sol-gel method, comprising the steps of:

applying a precursor solution for alining the ferrodielectric film made of the metal oxide film onto a surface of a first substrate on which the ferrodielectric film made of the metal oxide film is formed and forming a precursor film, and accumulating the precursor solution in a solution holder;

installing a glass substrate at a predetermined position inside the solution holder, such that the glass substrate contacts an upper face of the precursor solution and is disposed above the first substrate and the precursor solution, to block an opening of the solution holder;

collecting a light by lens onto an interface where the first substrate contacts the precursor film, the light collected by the lens passing through the glass substrate, and passing through the precursor film; and moving the light or the first substrate to scan the light while maintaining a condition of collecting the light passing through the glass substrate and the precursor solution onto the interface, to heat and crystallize the precursor film at the interface, to form the ferrodielectric film made of the metal oxide film on the first substrate.

* * * * *